US009180691B2

(12) United States Patent
Wanibuchi

(10) Patent No.: US 9,180,691 B2
(45) Date of Patent: Nov. 10, 2015

(54) PLATEN DEVICE AND PRINTER WITH THE PLATEN DEVICE

(71) Applicant: Seiko Epson Corporation, Tokyo (JP)

(72) Inventor: Hiroshi Wanibuchi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/200,949

(22) Filed: Mar. 7, 2014

(65) Prior Publication Data

US 2014/0267524 A1 Sep. 18, 2014

(30) Foreign Application Priority Data

Mar. 13, 2013 (JP) ..... 2013-050110

(51) Int. Cl.
*B41J 2/01* (2006.01)
*B41J 11/00* (2006.01)
*B41J 11/06* (2006.01)

(52) U.S. Cl.
CPC ..... *B41J 11/0085* (2013.01); *B41J 11/06* (2013.01)

(58) Field of Classification Search
CPC ..... B41J 11/0085
USPC ..... 347/104
See application file for complete search history.

(56) References Cited

U.S. PATENT DOCUMENTS

| | | | | |
|---|---|---|---|---|
| 3,527,166 | A * | 9/1970 | Jaffa et al. | 101/474 |
| 6,543,948 | B2 * | 4/2003 | Beehler et al. | 400/635 |
| 6,921,163 | B2 * | 7/2005 | Fujioka | 347/101 |
| 7,322,690 | B2 * | 1/2008 | Ishii et al. | 347/104 |
| 8,240,661 | B2 * | 8/2012 | Bober | 271/194 |
| 8,287,119 | B2 * | 10/2012 | Yamaguchi et al. | 347/104 |
| 8,317,197 | B2 * | 11/2012 | DeGruchy | 271/276 |
| 8,573,729 | B2 * | 11/2013 | Takamoto | 347/16 |
| 2007/0176956 | A1 * | 8/2007 | Fujioka et al. | 347/16 |
| 2010/0118098 | A1 * | 5/2010 | Ebihara | 347/104 |
| 2010/0220165 | A1 | 9/2010 | Maekawa et al. | |
| 2011/0253763 | A1 * | 10/2011 | Toya | 226/200 |
| 2012/0218341 | A1 | 8/2012 | Maekawa et al. | |
| 2013/0050375 | A1 * | 2/2013 | Ishimori et al. | 347/104 |

FOREIGN PATENT DOCUMENTS

JP 2010-201683 A 9/2010

* cited by examiner

*Primary Examiner* — Jannelle M Lebron
*Assistant Examiner* — Jeremy Bishop
(74) *Attorney, Agent, or Firm* — Nutter McClennen & Fish LLP; John J. Penny, Jr.; Joshua I. Rudawitz

(57) ABSTRACT

A platen device can easily change where suction is applied widthwise to a recording medium. A printer has the platen device. A platen device 50 opposite a printhead 41 applies suction to conveyed roll paper P, and has a platen 34 divided perpendicularly to the conveyance direction of the roll paper P into a plurality of individual suction zones 75 with round suction holes 83 in the surface on the side that contacts the roll paper P; and a plurality of shutters 85 disposed to the platen 34 and respectively opening or closing the round suction holes 83 in the plural individual suction zones 75 according to the width of the conveyed recording medium.

11 Claims, 10 Drawing Sheets

PLATEN DEVICE AND PRINTER WITH THE PLATEN DEVICE

BACKGROUND

1. Technical Field

The present disclosure relates to a platen device that applies suction to a conveyed recording medium, and to a printer having the platen device.

2. Related Art

One example of such a platen device is a suction platen mechanism disposed opposite the inkjet head in an inkjet roll paper printer such as described in JP-A-2010-201683.

This suction platen mechanism has a platen surface opposite the inkjet head, and a suction mechanism that holds recording paper conveyed over the platen surface against the platen surface by suction. The platen surface has a first suction zone substantially in the center of the transverse (widthwise) direction perpendicular to the conveyance direction of the recording paper, and two second suction zones on opposite sides of the first suction zone. The first suction zone and second suction zones are separated by ribs on the platen surface, and the second suction zones are further divided by a plurality of ribs into multiple subzones. A checkerboard grid of suction holes that communicate with a suction fan is formed in the first suction zone, and a suction hole formed in each of the subzones also communicates with the suction fan. Air can therefore be prevented from leaking from the sides of narrow recording paper, and the sides of wide recording paper can be prevented from lifting away from the platen surface.

To prevent air leakage when using narrow recording paper, this suction platen mechanism of the related art is designed so that suction is weaker in the second suction zones than in the first suction zone. As a result, thick paper that tends to curl at the sides of the width may be conveyed (printed) without this curling being removed due to insufficient suction in the second suction zones.

When printing on synthetic label paper having a plastic film with an adhesive backing carried on a paper liner, for example, the liner can absorb moisture (swell) and curl at the sides of the paper width under high temperature, high humidity conditions. Problems can then occur when the recording paper is conveyed over the platen surface with curled edges, including a drop in print quality because a desirable paper gap cannot be maintained, or the recording paper interfering with the inkjet head.

SUMMARY

A platen device and a printer having a platen device according to the present disclosure can easily change where suction is applied widthwise to the recording paper.

A platen device applying suction to a conveyed recording medium opposite a printhead has a platen divided perpendicularly to the conveyance direction of the recording medium into a plurality of suction zones with suction holes in the surface on the side that contacts the recording medium; and a plurality of shutters disposed to the platen and respectively opening or closing the suction holes in the plural suction zones according to the width of the conveyed recording medium.

By disposing a shutter in each of the plural suction zones corresponding to the width of the conveyed recording medium, the plural shutters can be selectively opened and closed to selectively and partially apply suction to the conveyed recording medium through the corresponding suction zones. Because the suction holes can be opened and closed by shutters, the construction for applying or not applying suction can be simplified. More specifically, the part where suction is applied widthwise to the recording medium can be easily changed. The shutters can be disposed on the inside side of the suction holes (inside the suction chamber), or on the outside (on the platen surface).

Preferably, the plural suction zones are divided by a plurality of guide ribs extending in the conveyance direction on the surface of the platen; the suction holes are disposed in the recessed surface of the platen between two adjacent guide ribs; and the shutters are disposed on the recessed surface.

Because the shutters are disposed on a recessed surface, the shutters can be easily attached to the platen and the shutters will not interfere with the conveyed recording medium. Furthermore, because suction is applied to the closed shutter through the suction holes, the shutter is held tight to the recessed surface. Leakage of air from a closed shutter can therefore be minimized, and thin shutters can be used. Unwanted air leaks can be further reduced because part of the shutter (such as the operator) does not pass into the suction chamber.

Further preferably, the shutters can move freely forward and back in the conveyance direction between an open position that opens and a closed position that closes the suction holes; and through-holes that communicate with the suction holes in the open position are formed in each shutter.

This configuration enables easily opening and closing the shutters. The open/close stroke of the shutter can also be shortened by providing through-holes in the shutter that communicate with the suction holes. A finger hold for operating the shutter can also be easily formed by providing a protrusion on the surface of the shutter. A plurality of suction holes are preferably formed at an equal interval in the one suction zone controlled by one shutter, and in this configuration the through-holes are preferably formed in the shutter at the same pitch as the suction holes.

Further preferably, a protrusion is disposed to the side wall of the guide rib; and two grooves that engage the protrusions in the open position and the closed position are disposed to the shutter.

When opening and closing the shutters, the open position and the closed position can be recognized by a positive click, and the shutters can be easily and reliably opened and closed.

Yet further preferably, the platen device also has a plurality of actuators that respectively open or close the shutters; and a control unit that individually controls the plural actuators, the control unit selectively controlling the plural actuators based on the input type of recording medium.

By automating operation of the shutters using an actuator, the shutters can be selectively opened and closed according to the type of recording medium. The area where suction is applied can be changed according to the type of recording medium, and different types of recording media can be desirably conveyed in contact with the platen.

The actuator is preferably a solenoid device. Rules for controlling operation of the plural actuators according to the type of recording medium is also preferably stored in a control table whether the type of recording medium is input manually or by sensors.

Another aspect of the disclosure preferably also has a plurality of actuators that respectively open or close the plural shutters; and a control unit that individually controls the plural actuators, the control unit selectively controlling the plural actuators based on the input temperature and humidity of the environment around the recording medium.

By automating operation of the shutters using an actuator, the shutters can be selectively opened and closed according to the temperature and humidity of the environment around the recording medium. The area where suction is applied can be changed with consideration for curling of the recording medium, and recording media whose condition can change according to the temperature and humidity can be desirably conveyed in contact with the platen.

The actuator is preferably a solenoid device. Rules for controlling operation of the plural actuators according to the type of recording medium is also preferably stored in a control table whether the temperature and humidity of the environment around the recording medium is input manually or by sensors.

Another aspect of the disclosure is a platen device that applies suction to a conveyed recording medium opposite a printhead, and has a platen divided perpendicularly to the conveyance direction of the recording medium into a plurality of suction zones with suction holes in the surface on the side that contacts the recording medium; a plurality of suction chambers corresponding to the plural suction zones disposed to the platen and communicating with the suction holes; a plurality of air channels communicating respectively with the plural suction chambers; a common air channel in which the plural air channels merge and communicate with the air suction source; and a plurality of dampers disposed respectively in the plural air channels to open or close the corresponding air channel.

By disposing a damper in each of the plural air channels corresponding to the plural suction zones, the plural dampers can be selectively opened and closed to selectively and partially apply suction to the conveyed recording medium through the corresponding suction zones. Because the air channels can be opened and closed by dampers, the construction for applying or not applying suction can be simplified. More specifically, the part where suction is applied widthwise to the recording medium can be easily changed.

The plural air channels are preferably configured as ducts with dividers therebetween. The dampers are also preferably rotatable.

Further preferably, the platen device also has a plurality of actuators that respectively open or close the plural dampers; and a control unit that individually controls the plural actuators.

By automating operation of the dampers using an actuator, the dampers can be selectively opened and closed according to the type of recording medium.

The actuator is preferably a rotating solenoid device.

Another aspect of the disclosure is a printing device including the platen device described above, and an inkjet printhead.

This configuration enables easily changing where suction is applied widthwise to the recording medium, and desirably conveying recording media of different qualities and properties. A desirable paper gap can therefore be maintained between the printhead and the recording medium, and consistent print quality can be achieved.

Other objects and attainments together with a fuller understanding of the disclosure will become apparent and appreciated by referring to the following description and claims taken in conjunction with the accompanying drawings.

DESCRIPTION OF EMBODIMENTS

Preferred embodiments of a platen device and a printing device according to the disclosure are described below with reference to the accompanying figures. The printing device according to the following embodiments is an inkjet printer that prints primarily on recording paper (recording media), and has a platen device that applies suction to the recording medium conveyed for printing in order to maintain a desirable paper gap when printing. The platen device has a platen connected to an air suction source, and the platen has an area where suction is constantly applied to the recording medium, and an area where suction is selectively applied by operating a shutter.

Figure 1:
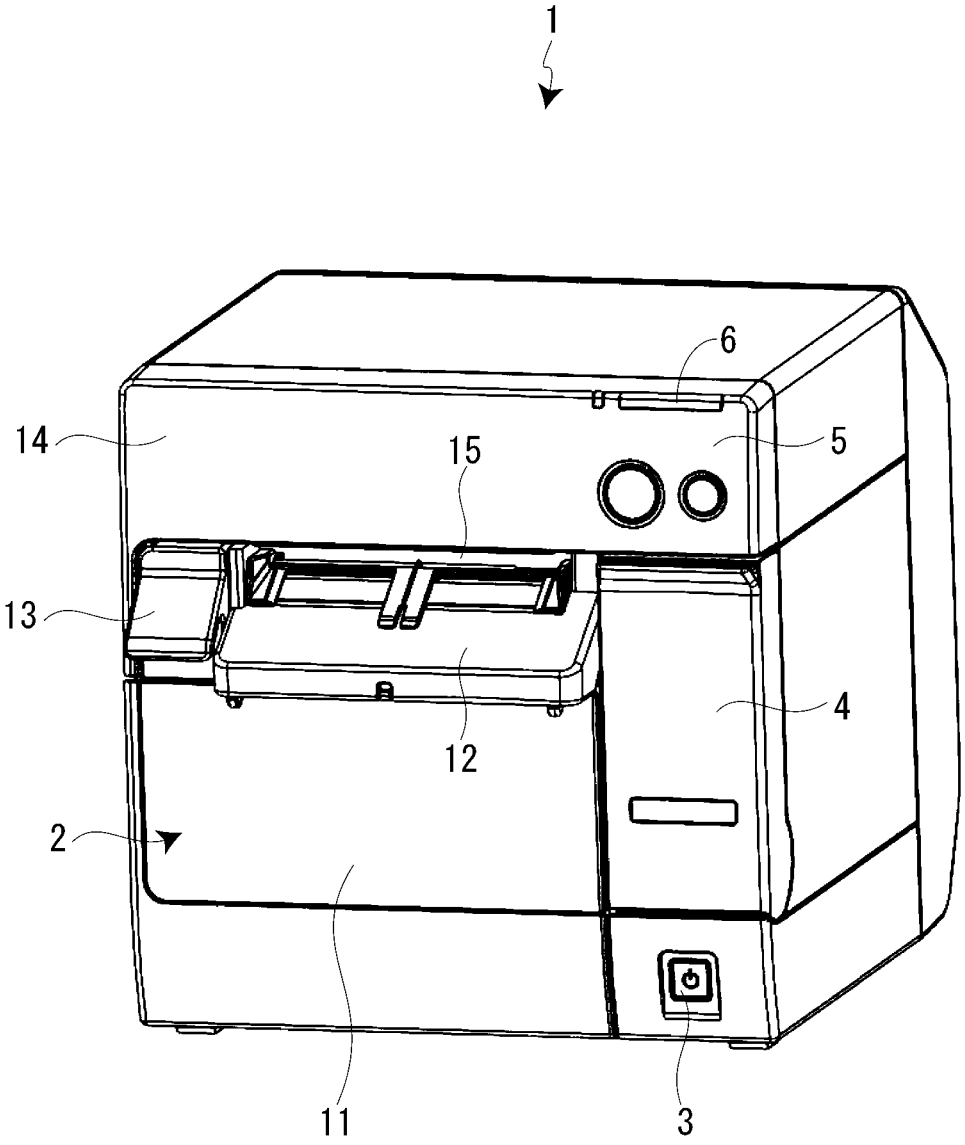
FIG. 1 is an external oblique view of a printing device according to the disclosure.
Figure 2:
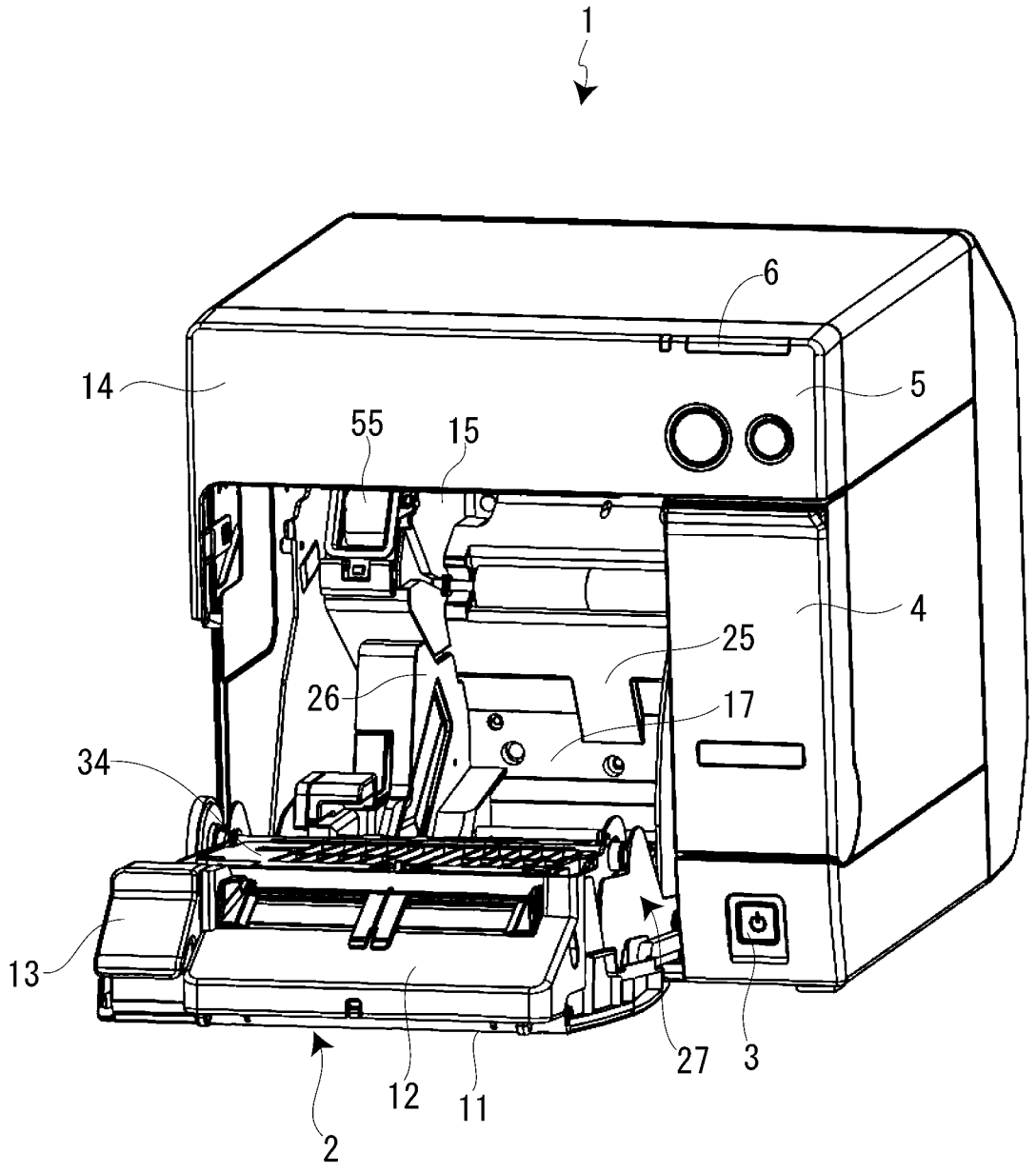
FIG. 2 is an external oblique view of a printing device according to the disclosure with the front cover open.

FIG. 1 is an external oblique view of a printing device according to the first embodiment of the disclosure, and FIG. 2 is an external oblique view of the printer with the front cover open. As shown in the figures, the printing device (printer) 1 has a basically box-like case with a front cover 2 that opens to expose the inside of the printer 1. In the front of the printer 1 on the right side of the front cover 2 are, from the bottom, a power button 3, an access cover 4 that opens and closes the ink cartridge compartment, operating buttons 5 including a button for operating a paper cutter, for example, and a group of indicators 6. A manual paper supply opening 7 is formed at the top (FIG. 3), and an air vent 8 for the suction fan 51 (air suction source) described below is formed at the bottom (FIG. 4), of the back of the printer 1.

The front cover 2 has a main cover 11, a paper exit guide 12 located at the top of the main cover 11, and an operating lever 13 on the left side of the paper exit guide 12. A paper exit 15 is between the top of the paper exit guide 12 and the main case 14. When the operating lever 13 is operated to unlock the main cover 11 and the paper exit guide 12 is pulled forward, the front cover 2 swings down and opens pivoting at the bottom end. This exposes the roll paper compartment 17 formed inside the printer 1, and enables replacing the roll paper P with a simple drop-in method. As described in further detail below, the platen 34 is also pulled forward when the front cover 2 opens, exposing the roll paper P conveyance path 31.

Figure 3:
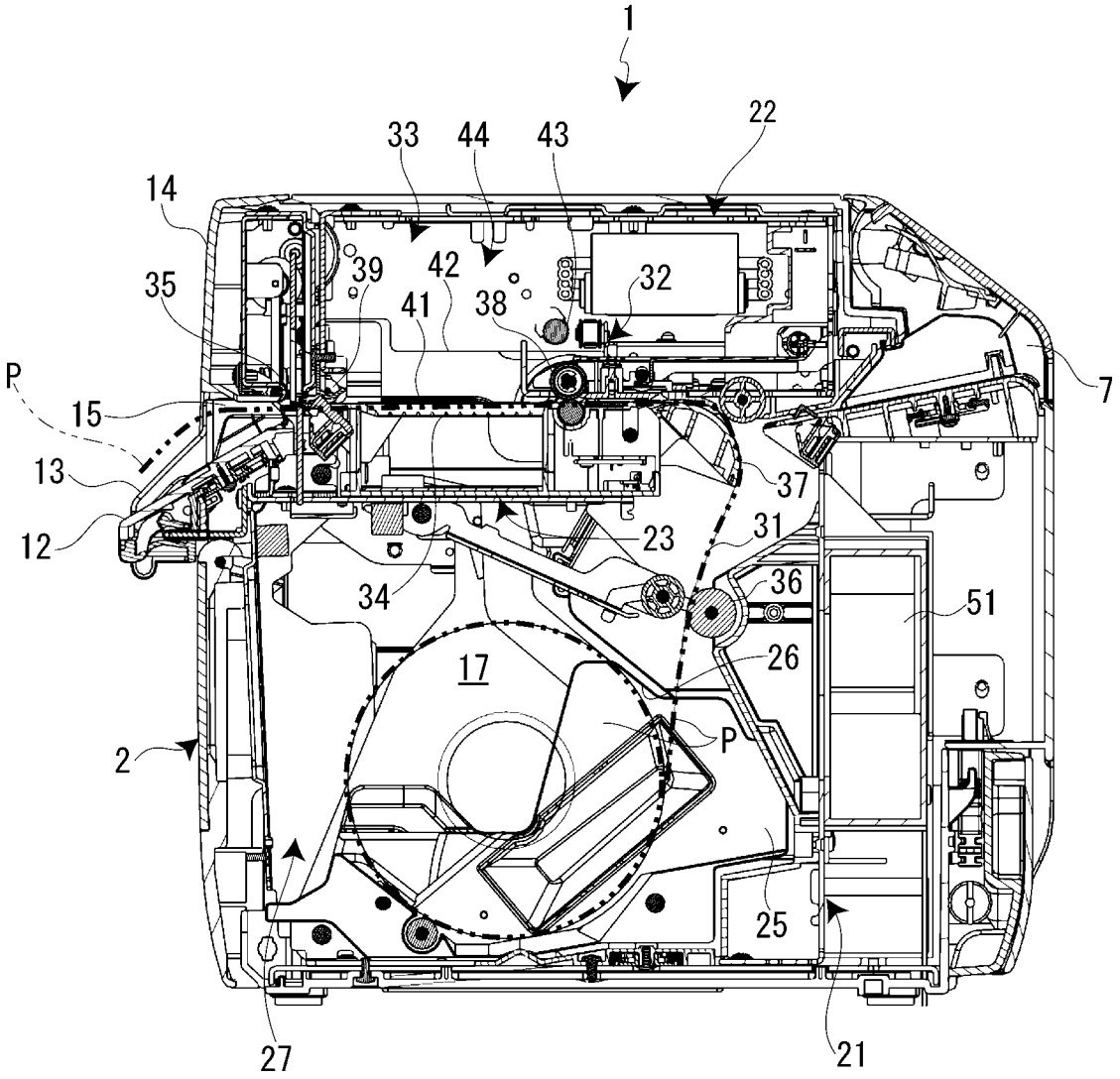
FIG. 3 is a section view showing the internal configuration of the printing device according to the disclosure.

As shown in FIG. 3, disposed inside the printer 1 are a main frame 21; a print unit frame 22 disposed above the main frame 21 and primarily supporting the print mechanism 33 described below; and a platen unit frame 23 disposed below the main frame 21 and primarily supporting the platen 34 described below. A circumferential guide 25 and a pair of left and right side guides 26 (FIG. 2) that render the roll paper compartment 17 are supported on the main frame 21, and the side guides 26 can be adjusted (centered) according to the width of the roll paper P that is loaded.

The platen unit frame 23 supporting the platen 34 is supported by a linkage mechanism 27 connected to the front cover 2. This linkage mechanism 27 is a four-node parallel linkage mechanism including the platen unit frame 23 as one link on the movable side and the main frame 21 as one link on the stationary side. When the front cover 2 opens, the linkage mechanism 27 operates as though pulled by the front cover 2, and the platen 34 and platen unit frame 23 are opened to the outside as though they are mounted on the back side of the open front cover 2 while remaining in a substantially horizontal position. As a result, there is clear, wide access to the roll paper compartment 17, and the roll paper P conveyance path 31 is open. When the front cover 2 closes, the platen 34 and platen unit frame 23 are returned to the original positions while remaining substantially horizontal.

Inside the printer 1 are a roll paper compartment 17 to which roll paper P can be dropped in and loaded; a conveyance path 31 extending up from the back of the roll paper compartment 17 and then horizontally to the paper exit 15; a paper feed mechanism 32 that conveys the roll paper P along the conveyance path 31; a print mechanism 33 facing the horizontal part of the conveyance path 31 from above; and the platen 34 opposite the print mechanism 33 with the conveyance path 31 therebetween. A cutter 35 that cuts the roll paper P on the conveyance path 31 is disposed near the paper exit 15.

The paper feed mechanism 32 includes a paper feed roller 36 disposed diagonally behind the roll paper compartment 17, a tension guide 37 disposed where the conveyance path 31 changes course, a paper feed roller 38 disposed near the upstream side of the platen unit frame 23, and a discharge roller 39 disposed near the downstream side of the platen 34. The paper feed roller 36, paper feed roller 38, and discharge roller 39 are nip rolls including a drive roller and a driven roller.

The tension guide 37 can pivot freely vertically, is urged to pivot up, and maintains constant tension on the roll paper P between the paper feed roller 36 and paper feed roller 38 so that the roll paper P wound in a roll can be delivered smoothly from the roll paper compartment 17. The discharge roller 39 is configured to turn at a slightly greater circumferential speed than the paper feed roller 38 (to slip), and applies constant tension to the roll paper P conveyed over the platen 34 (keeping the paper tight).

The paper feed roller 36, paper feed roller 38, and discharge roller 39 turn synchronously, and convey the roll paper P through the conveyance path 31. As described in further detail below, the paper feed mechanism 32 conveys (line feeds) the roll paper P intermittently synchronized to the print mechanism 33 while printing. When the paper feed mechanism 32 turns freely immediately after the roll paper P is loaded, pressing one of the operating buttons 5 intermittently feeds the roll paper P. Similarly, the leading end of the conveyed roll paper P is cut by the cutter 35 when one of the operating buttons 5 is pressed, and is then reversed slightly to index the paper before printing.

The print mechanism 33 includes a printhead 41, which is an inkjet head; a carriage 42 that carries the printhead 41; a guide shaft 43 that supports the carriage 42 movably right and left; and a moving mechanism 44 that moves the carriage 42 right and left along the guide shaft 43. The printhead 41 is a color printhead that selectively ejects four colors of ink, yellow, magenta, cyan, and black, from the ink cartridges.

While not specifically shown in the figures, the moving mechanism 44 includes a timing belt wrapped around a drive pulley and a driven pulley, and a carriage motor that drives the timing belt forward and reverse through the drive pulley. Part of the timing belt is attached to the carriage 42, and when the carriage motor turns forward and reverse, the printhead 41 mounted on the carriage 42 moves bidirectionally left and right.

More specifically, while the moving mechanism 44 moves the printhead 41 out and back in the left-right direction, the printhead 41 is driven to selectively eject the four colors of ink and print (primary scanning direction), and the roll paper P is advanced one line (secondary scanning direction) between the out and back movements of the printhead 41. A continuous color printing process is thus applied to the roll paper P. When one color printing process is completed and the paper is advanced the margin between pages, feeding the roll paper P stops, the cutter 35 operates, and the printed portion of the roll paper P is cut off (discharged).

Figure 4:
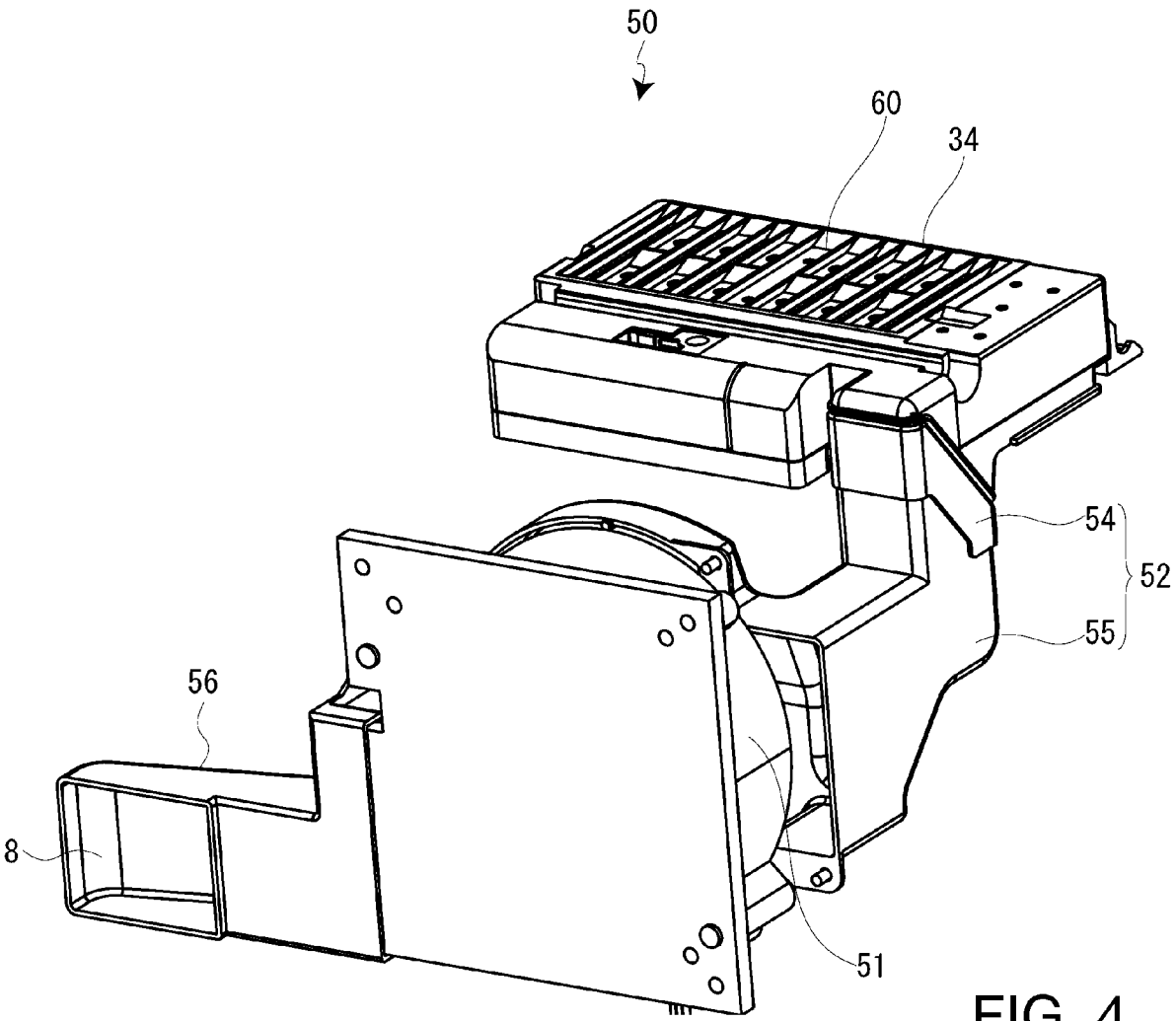
FIG. 4 is an oblique view of the complete platen device.

As shown in FIG. 3 and FIG. 4, the platen 34 in this embodiment is part of a platen device 50 including a suction fan 51 supported on the back of the main frame 21, and a suction duct 52 that connects the suction fan 51 with the platen 34. As described in detail below, the platen device 50 applies suction to the roll paper P conveyed over the platen 34 by the paper feed mechanism 32, and holds the part of the roll paper P being printed flat. As a result, a desirable gap, specifically a desirable paper gap, is maintained between the roll paper P and the printhead 41.

As described above, the platen 34 moves with the front cover 2 opening and closing, and the suction fan 51 is disposed to a stationary position in the back of the printer 1. The suction duct 52 in this embodiment therefore includes a platen-side duct 54 that is attached to the platen 34 and moves with the platen 34, and a fan-side duct 55 attached to the suction fan 51 side. The platen-side duct 54 and fan-side duct 55 can therefore connect and disconnect freely.

When the front cover 2 is closed, there is an air-tight connection between the downstream end of the platen-side duct 54 and the upstream end of the fan-side duct 55, and when the front cover 2 opens from this position, the platen-side duct 54 and fan-side duct 55 disconnect and move apart.

The suction fan 51 is a centrifugal fan, for example, has the fan-side duct 55 connected to the inlet side, and has an exhaust duct 56 with the air vent 8 connected to the outlet side. The suction fan 51 drives synchronized to the power turning on/off, and applies suction through the platen 34 to the roll paper P conveyed by the paper feed mechanism 32. During the actual printing operation in which the roll paper P is advanced intermittently, the platen 34 holds the roll paper P when conveyance is stopped, and applies vacuum power (suction) to the roll paper P while the paper is advanced.

As seen in FIG. 4 to FIG. 7, the platen 34 is shaped like a box with a wide suction zone 60 offset to the right side (one side) of the top panel 61, and an internal suction chamber 62 that communicates with the suction zone 60. In the platen 34 in this embodiment, the top panel 61 including the suction zone 60 and the four side walls 63 are formed in unison, and a bottom panel 64 is attached thereto (see FIG. 7). The platen-side duct 54 is connected to the far left part of the platen 34, and the suction chamber 62 communicates with the suction fan 51 (FIG. 4) through this platen-side duct 54 and the fan-side duct 55 described above.

Figure 5:
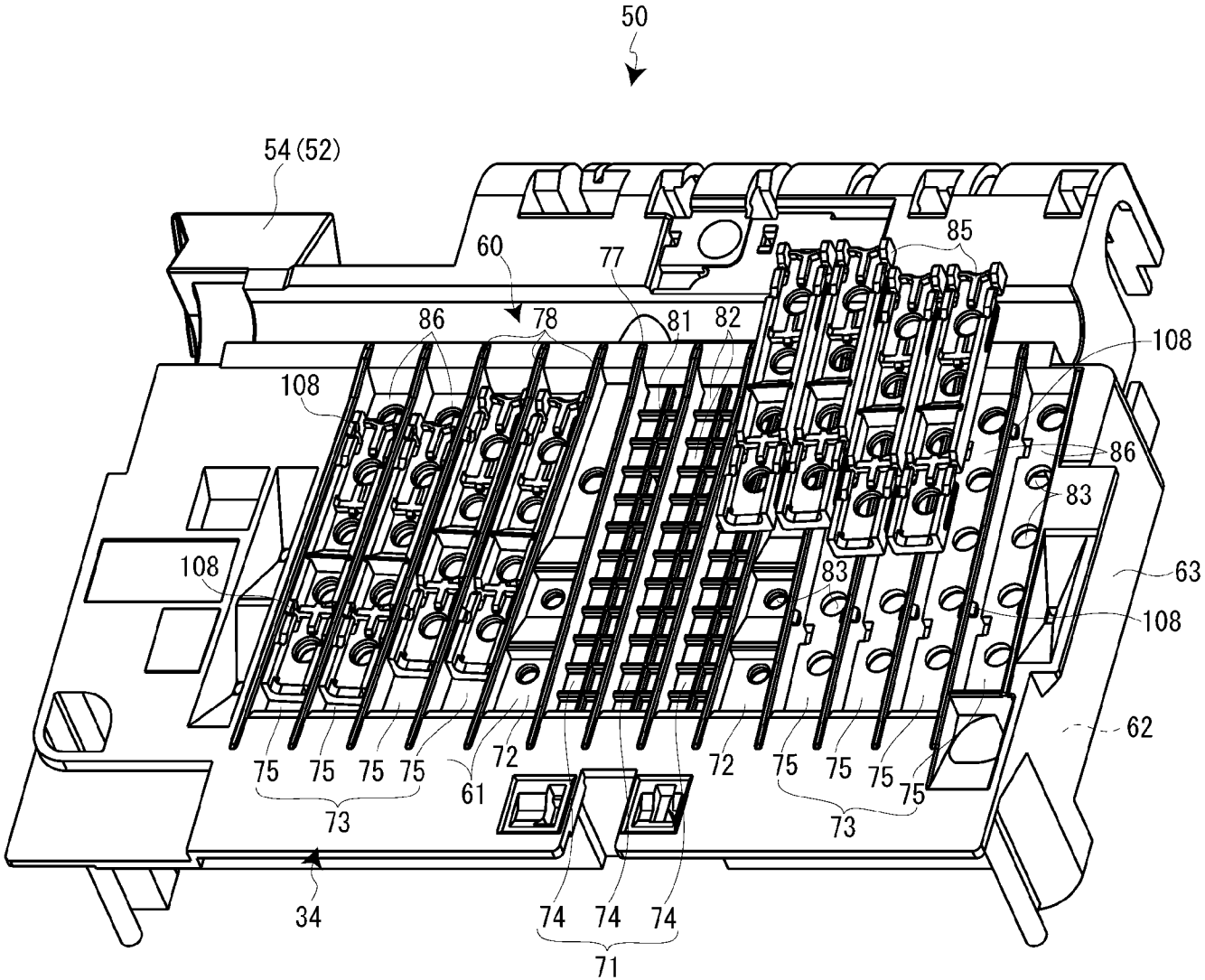
FIG. 5 is a partially exploded oblique view of the area around the platen.
Figure 6:
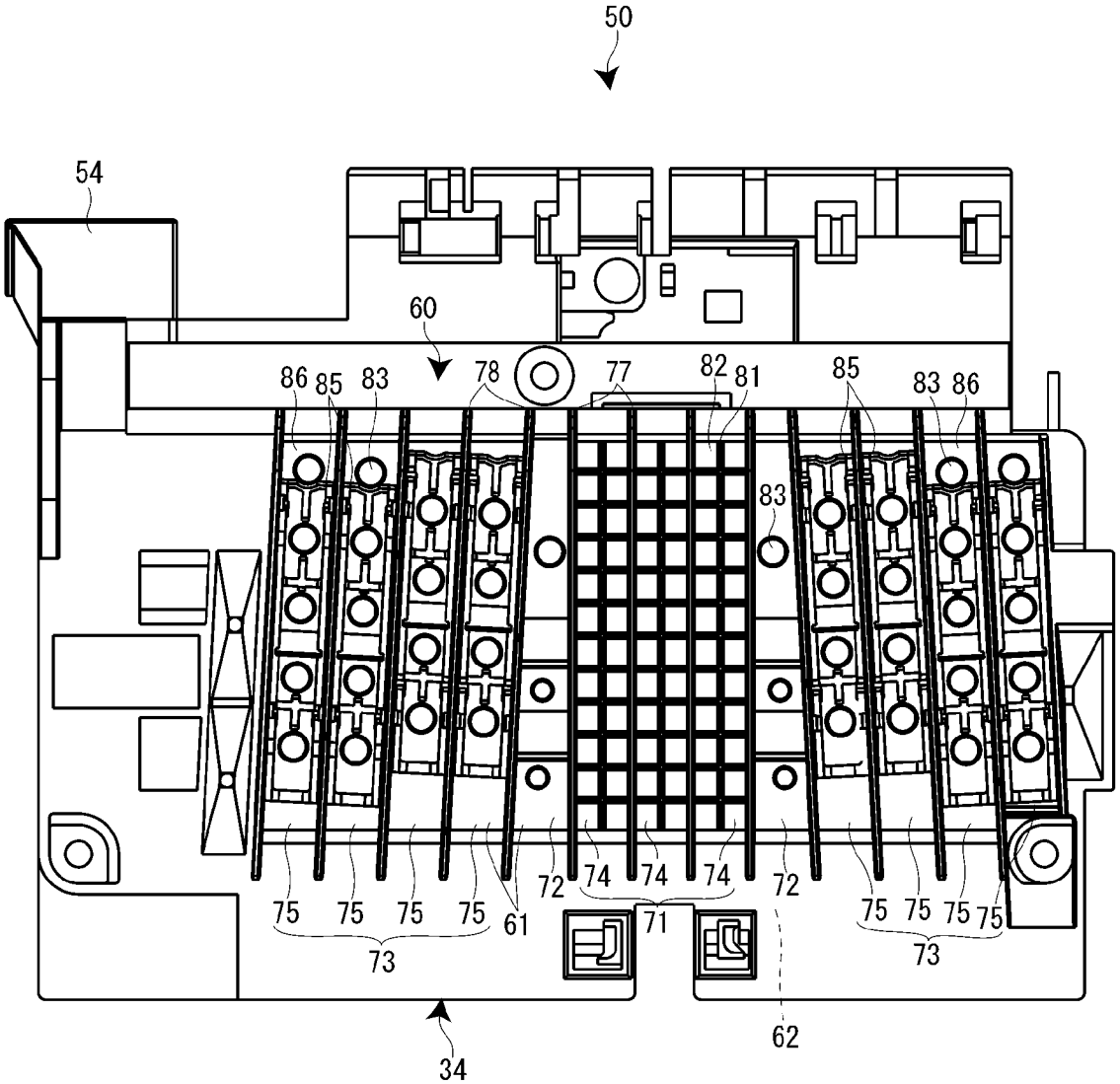
FIG. 6 is a plan view of the area around the platen.

As shown in FIG. 5 and FIG. 6, the suction zone 60 has a first suction zone 71 in the middle between the left and right sides, a pair of trapezoidally-shaped left and right second suction zones 72 on opposite sides of the first suction zone 71, and a pair of left and right third suction zones 73 on the outside sides of the second suction zones 72. The first suction zone 71 has a plurality (three in this example) of subzones 74, and the third suction zones 73 each have a plurality of subzones 75 (four each for a total of eight in this embodiment).

More specifically, the first suction zone 71 is segmented into three subzones 74 by four first guide ribs 77 extending the roll paper P conveyance direction. The second suction zones 72 are formed by the outside first guide rib 77 and the inside second guide rib 78 extending at a slight angle to the roll paper P conveyance direction. The third suction zones 73 are also segmented into four subzones 75 by five second guide ribs 78 (rib-shaped guides) including the inside second guide rib 78.

The first guide ribs 77 and second guide ribs 78 are the same height, and protrude above parts of the top panel 61 outside the suction zone 60. The top panel 61 is recessed in the parts of the suction zone 60 between the plural first guide ribs 77 and the plural second guide ribs 78. Because the roll paper P is conveyed centered, narrow roll paper P is conveyed over the plural first guide ribs 77, and wide roll paper P is conveyed over the plural first guide ribs 77 and plural second guide ribs 78 (see FIG. 7).

A checkerboard-shaped grid member 81 is disposed instead of the top panel 61 in the subzones 74 of the first suction zone 71, and a plurality of rectangular suction holes 82 are formed in the spaces of the grid member 81. Three round suction holes 83 are formed in the top panel 61 in each of the second suction zones 72. The plural rectangular suction holes 82 in the first suction zone 71 and the three round suction holes 83 in the second suction zones 72 communicate constantly with the suction chamber 62, applying constant suction to the roll paper P when the suction fan 51 is running.

Five round suction holes 83 are formed in the top panel 61 in each of the subzones 75 of the third suction zones 73. The five round suction holes 83 are formed at an equal interval in rows parallel to the second guide ribs 78, and a shutter 85 is disposed positioned on the top panel 61 in each of the subzones 75 so that the five round suction holes 83 open and close simultaneously. The shutters 85 can slide freely forward and back on the recessed surfaces 86 of the top panel 61 formed between two adjacent second guide ribs 78. The round suction holes 83 in the eight subzones 75 of the pair of third suction zones 73 can be selectively opened and closed individually by subzone 75 unit by operating the shutters 85.

Figure 7:
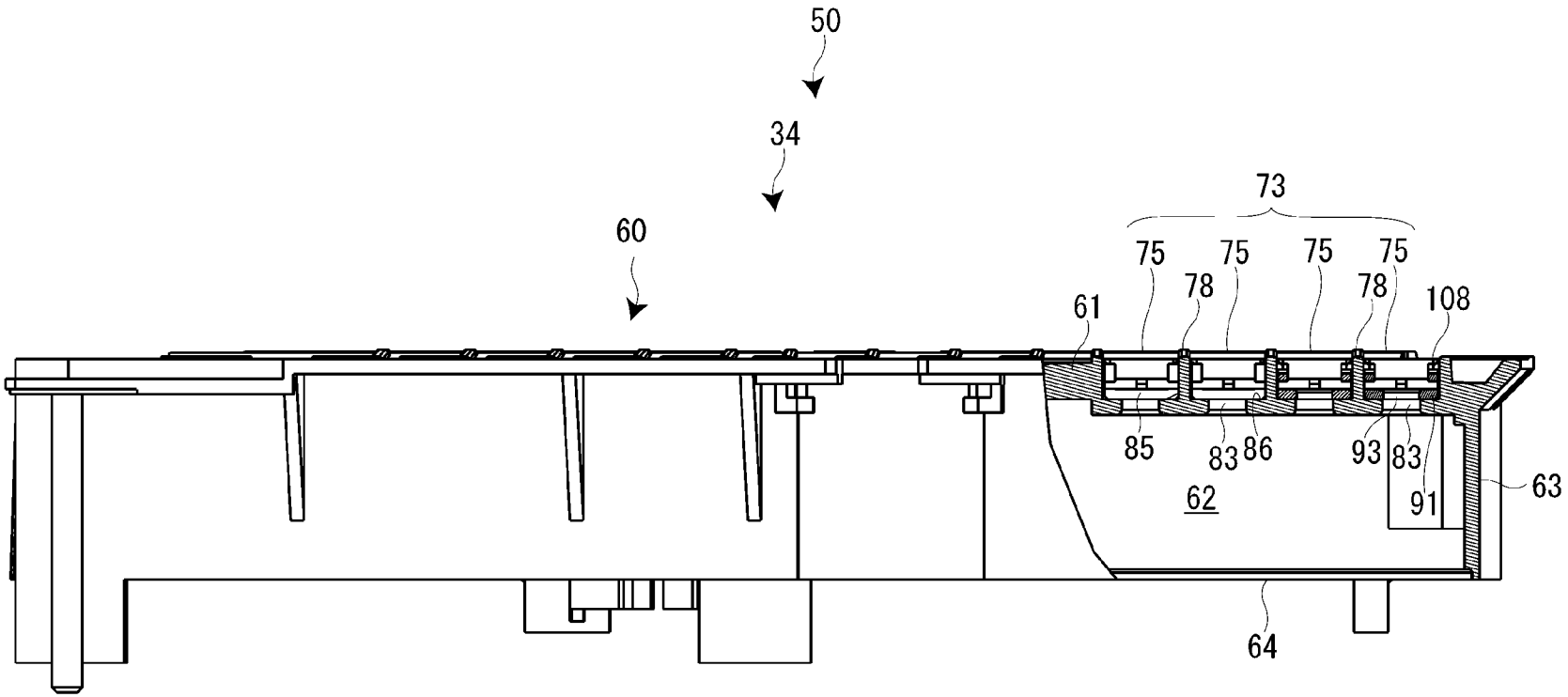
FIG. 7 is a section view of the platen.
Figure 8:
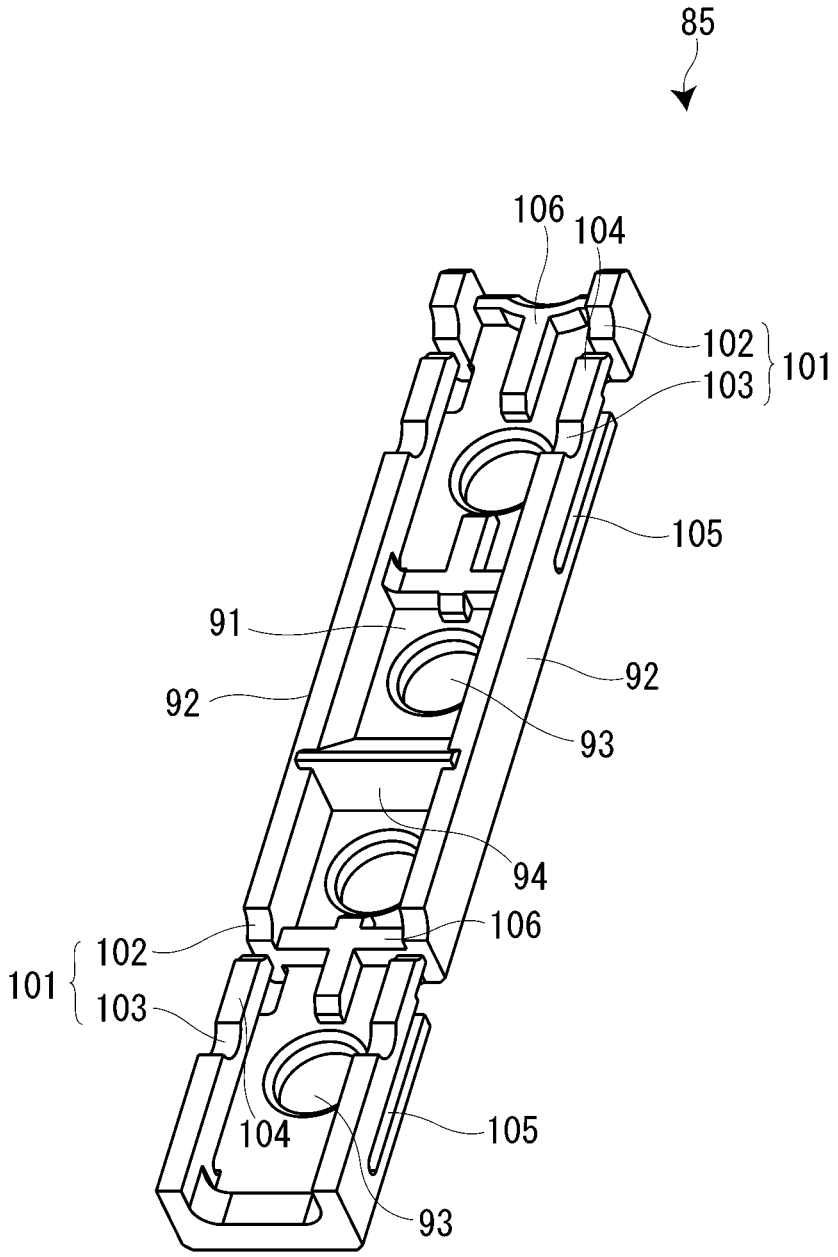
FIG. 8 is an oblique view of the shutter.

As shown in FIG. 5, FIG. 7, and FIG. 8, each shutter 85 has a width corresponding to the width between the second guide ribs 78, a length that covers the five round suction holes 83, and a U-shaped section formed by a base 91 and two sides 92 formed in unison. The base 91 slides freely in contact with the recessed surface 86 of the top panel 61, and the sides 92 slide freely in contact with the second guide ribs 78. Four round through-holes 93 are formed in the base 91 with the same diameter and at the same pitch as the five round suction holes 83. A transverse finger hold 94 that is shaped like a peak in section rises from the base 91 in the middle between the front and back ends of the shutter 85. Note that the round suction holes 83 and round through-holes 93 have a chamfered edge, and are therefore shown by double lines in the figure.

When the shutter 85 is advanced to the forward position in contact with the upstream end of the subzone 75 by the finger hold 94, the five round suction holes 83 are offset from the four round through-holes 93 in the shutter 85, and the five round suction holes 83 are closed. When the shutter 85 is moved to the retracted position in contact with the downstream end of the subzone 75, one of the five round suction holes 83 separates from the shutter 85, the other four round suction holes 83 are aligned with the four round through-holes 93 in the shutter 85, and the five round suction holes 83 are open.

Two sets (pairs) of front and back detent grooves 101 each including a V-shaped first detent groove 102 and a curved second detent groove 103 are formed in each side 92. A slide 104 is formed lower than the top of the side 92 between the first detent groove 102 and second detent groove 103. A slit 105 is formed from the first detent groove 102 past the second detent groove 103 parallel to the slide 104 in each side 92. This enables the side 92 to spring vertically in half of the first detent groove 102, the slide 104, and the second detent groove 103. The T-shaped parts protruding from the surface of the base 91 are reinforcements 106.

A pair of front and back detents 108 are disposed to the side walls of the second guide ribs 78 at positions corresponding to the two front and back sets of detent grooves 101. The detents 108 are semicircular when seen from the front, and protrude from the side walls of the second guide ribs 78.

When the shutter 85 is moved to the forward closed position, the front and back pair of second detent grooves 103 engage the corresponding detents 108, and when moved to the retracted open position, the front and back pair of first detent grooves 102 engage the corresponding detents 108. When moving from the forward position to the retracted position, and when moving from the retracted position to the forward position, the slides 104 of the shutter 85 slide against the detents 108. A positive click is thus achieved when the shutter 85 opens and closes, and the shutter 85 can be reliably opened and closed.

The first detent groove 102 is also split, and the shutter 85 can be removably set into the recessed surface 86 by aligning the parts of the groove extending to the base 91 in this split with the detents 108, and then pushing the shutter 85 in. This enables easily replacing the shutter 85.

When narrow roll paper P is loaded with the platen device 50 thus comprised, the roll paper P is preferably conveyed with all shutters 85 closed. This enables holding the full width of the roll paper P to the platen 34 while suppressing the leakage of air. Alternatively, the inside two or four shutters 85 could be closed to actively suction ink mist caused by the ink discharge. In this event, a filter is preferably included in the suction chamber 62 to collect the ink mist.

When wide roll paper P is loaded, the roll paper P is preferably conveyed with all shutters 85 open. This enables holding the full width of the roll paper P to the platen 34 while suppressing the leakage of air. When roll paper P such as synthetic label paper with a paper liner that curls easily is loaded, the roll paper P is preferably conveyed with, for example, the four inside shutters 85 closed and the four outside shutters 85 open. Closing the four inside shutters 85 increases the suction force on the roll paper P (when the total air flow is constant) at the outside edges, overcomes any curling, and holds the roll paper P.

As described above, by disposing a shutter 85 to each of the plural (eight) subzones 75 in this embodiment, suction can be selectively applied to parts of the conveyed roll paper P through the plural subzones 75 by selectively opening and closing the plural shutters 85. More particularly, suction of the roll paper P can be changed according to the type and properties of the roll paper P, for example. Different types of roll paper P can therefore be desirably conveyed over the platen 34, and consistent print quality can be maintained.

Because the shutters 85 are disposed to the recessed surface 86, the shutters 85 can be easily installed to the platen 34, and the shutters 85 do not interfere with conveyance of the roll paper P. Furthermore, because the shutters 85 are disposed to the recessed surface 86, that is, the surface of the top panel 61 of the platen 34, the closed shutters 85 can be held to the surface of the top panel 61 by the suction force, and leakage of air from the closed shutters 85 can be minimized.

A platen device 50A according to a second embodiment of the disclosure is described below next with reference to FIG.

Figure 9:
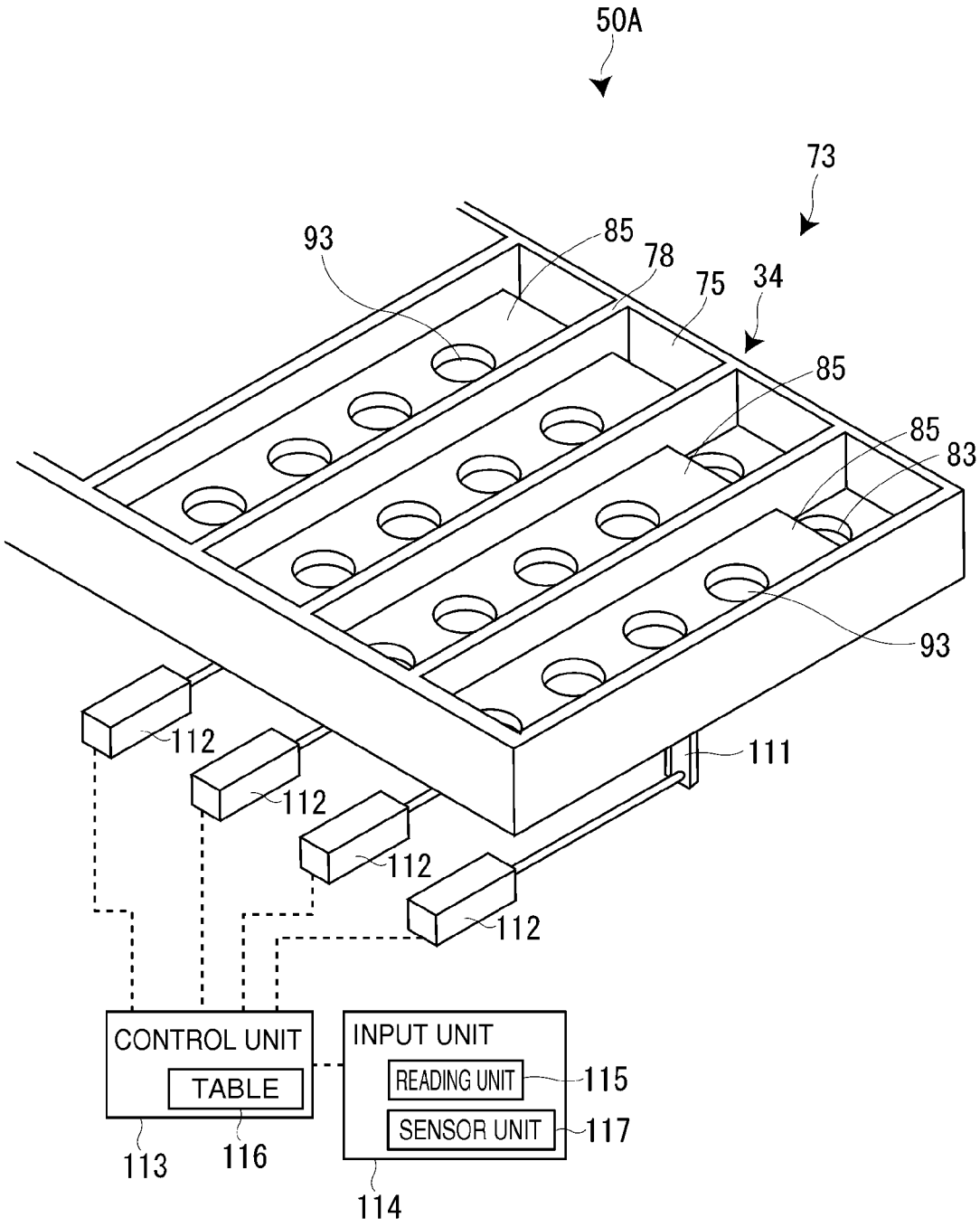
FIG. 9 schematically describes a platen device according to a second embodiment of the disclosure.

9, focusing primarily on the differences with the first embodiment. FIG. 9 schematically shows one of the third suction zones 73, and each shutter 85 can be automatically opened and closed in this embodiment.

A solenoid 112 is connected as an actuator to each shutter 85 through a shutter operator 111. The solenoid 112 is preferably a small, two-position (double action) device.

Each solenoid 112 is connected to a control unit 113, and the control unit 113 is connected to an input unit 114. Based on input data from the input unit 114, the control unit 113 individually controls the plural (eight) solenoids 112. The input unit 114 has a reading unit 115 that reads an RFID tag, barcode, 2D code symbol, or black marks, on the loaded roll paper P, and outputs the type of roll paper P to the control unit 113. The control unit 113 stores a control table 116 defining the relationship between the type of roll paper P and the open/closed states of the plural shutters 85, and based on the type of roll paper P, controls the plural solenoids 112 to selectively open or close plural shutters 85 such as described above.

Alternatively, the input unit 114 has a sensor unit 117 that detects temperature and humidity instead of the reading unit 115, or a sensor unit 117 that detects temperature and humidity in addition to the reading unit 115. In this configuration, the sensor unit 117 is disposed near the platen 34, and detects the temperature and humidity of the environment around the platen 34. The control table 116 also stores the relationship between the temperature and humidity around the platen 34 and the open/closed states of the plural shutters 85, or stores the relationship between the type of roll paper P, the temperature and humidity around the platen 34, and the open/closed states of the plural shutters 85.

In this configuration, the shutters 85 are selectively opened and closed based on the temperature and humidity of the environment around the platen 34, or the shutters 85 are selectively opened and closed based on the type of roll paper P and the temperature and humidity of the environment around the platen 34.

By automatically opening and closing the shutters 85 in this way, the roll paper P can be consistently desirably conveyed, and consistent print quality can be maintained.

Figure 10:
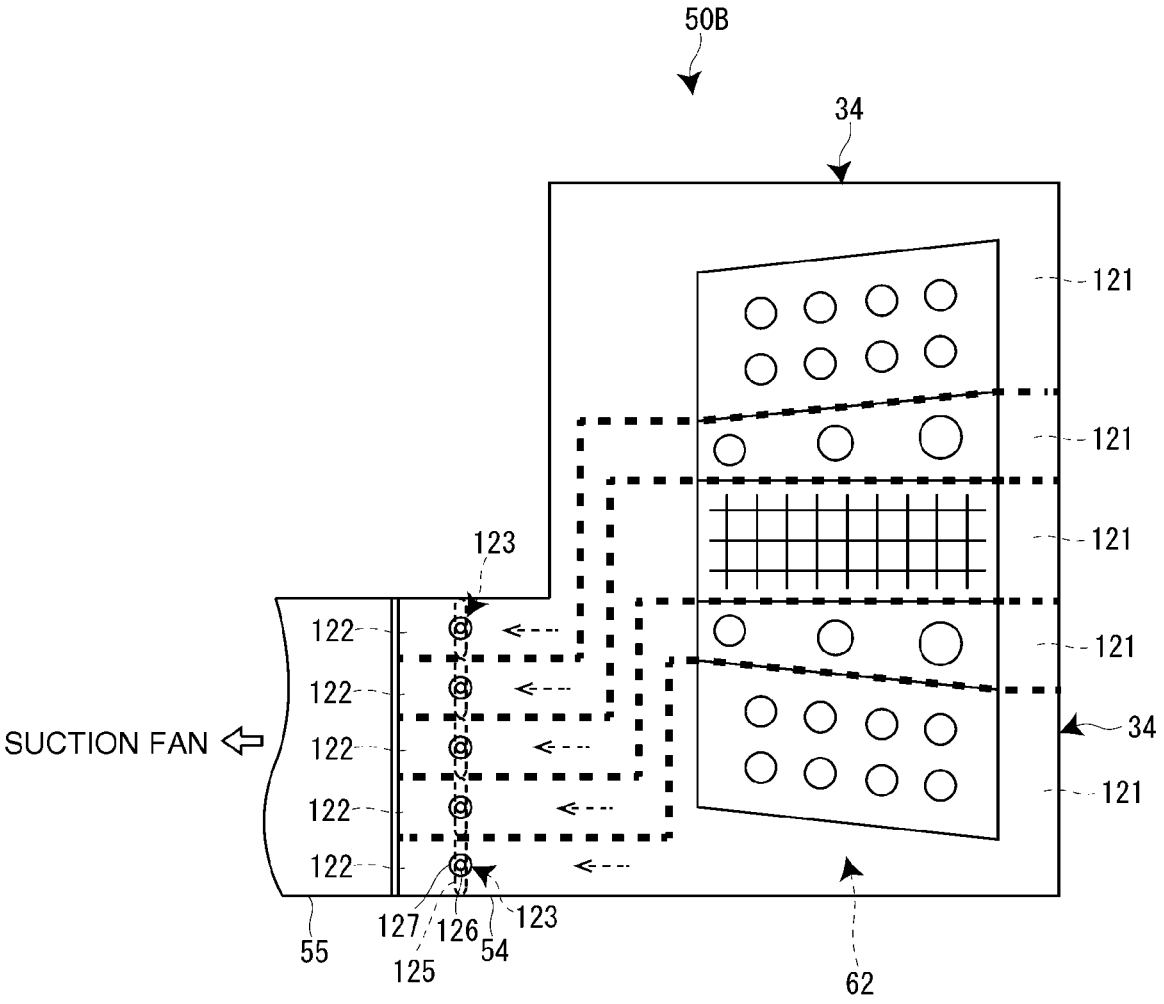
FIG. 10 schematically describes a platen device according to a third embodiment of the disclosure.

A platen device 50B according to a third embodiment of the disclosure is described below next with reference to FIG. 10, focusing primarily on the differences with the first embodiment. This embodiment selectively applies suction through the first suction zone 71, the pair of second suction zones 72, and the pair of third suction zones 73 (total five zones) by operating a damper 123 described below.

In the platen device 50B according to the third embodiment of the disclosure, the suction chamber 62 of the platen 34 is divided into five individual chambers 121 corresponding to the first suction zone 71, the pair of second suction zones 72, and the pair of third suction zones 73. The platen-side duct 54 connected to the suction chamber 62 is also divided into five long individual ducts 122 (air channels). A damper 123 is disposed to each individual duct 122. The fan-side duct 55 (common air path) is a single flow channel in which the five individual ducts 122 merge and communicate with the suction fan 51.

Each damper 123 has a damper plate 125, a support shaft 126 that rotatably supports the damper plate 125, and a damper operator 127 for rotating the support shaft 126. The damper operator 127 is exposed outside the damper 123, the individual duct 122 opens when the damper operator 127 is turned so that the damper plate 125 is parallel to the air channel, and the individual duct 122 closes when the damper operator 127 is turned so that the damper plate 125 is perpendicular to the air channel. For example, when the two dampers 123 located in the outside channels in the figure are closed, air is not pulled through the pair of third suction zones 73, but air is suctioned through the first suction zone 71 and the pair of second suction zones 72.

By disposing a damper 123 to each of the five individual ducts 122 corresponding to the first suction zone 71, the pair of second suction zones 72, and the pair of third suction zones 73, suction can be selectively applied to parts of the conveyed roll paper P through the first suction zone 71, the pair of second suction zones 72, and the pair of third suction zones 73 by selectively opening and closing the five dampers 123. More specifically, suction of the roll paper P can be changed according to the type and properties of the roll paper P, for example. Different types of roll paper P can therefore be consistently desirably conveyed over the platen 34, and consistent print quality can be maintained.

A rotary solenoid 112 could also be connected to the damper operators 127, and the dampers 123 opened and closed automatically. In this configuration, the solenoids 112 can be connected to a control unit 113 and input unit 114, and controlled as described in the second embodiment (see FIG. 9).

By automatically opening and closing the dampers 123, the roll paper P can be consistently desirably conveyed, and consistent print quality can be maintained.

The platen devices in the foregoing embodiments are described as used in a serial printing device (inkjet printer), but the platen device of the disclosure can obviously also be used in a line printer (inkjet printer). Shutters are also not disposed to the first suction zone and second suction zones in the first and second embodiments, but shutters can obviously be provided in these zones. The shutters could also be disposed inside the top panel. In this configuration, separate operators can be provided to operate the shutters from outside the platen.

The disclosure being thus described, it will be obvious that it may be varied in many ways. Such variations are not to be regarded as a departure from the spirit and scope of the disclosure, and all such modifications as would be obvious to one skilled in the art are intended to be included within the scope of the following claims.

What is claimed is:

1. A platen device applying suction to a conveyed recording medium opposite a printhead, comprising:

a platen divided perpendicularly to a conveyance direction of the recording medium into a plurality of suction zones with suction holes in a surface of the platen that contacts the recording medium;

a plurality of shutters disposed above the surface of the platen, the plurality of shutters respectively opening or closing the suction holes according to a width of the conveyed recording medium;

the conveyance path of the conveyed medium over the platen is above the plurality of shutters;

the plural suction zones are divided by a plurality of guide ribs extending in the conveyance direction on the surface of the platen;

the suction holes are disposed in a recessed surface of the platen between two adjacent guide ribs; and the shutters are disposed on the recessed surface.

2. The platen device described in claim 1, wherein:

the shutters can move freely forward and back in the conveyance direction between an open position that opens and a closed position that closes the suction holes; and through-holes that communicate with the suction holes in the open position are formed in each shutter.

3. The platen device described in claim 2, wherein:

a protrusion is disposed on a side wall of each of the guide ribs; and two grooves that engage the protrusions in the open position and the closed position are disposed on the shutter.

4. The platen device described in claim 3, further comprising:

a plurality of actuators that respectively open or close the plural shutters; and a control unit that individually controls the plural actuators, the control unit selectively controlling the plural actuators based on an input type of the recording medium.

5. The platen device described in claim 3, further comprising:

a plurality of actuators that respectively open or close the plural shutters; and a control unit that individually controls the plural actuators, the control unit selectively controlling the plural actuators based on an input temperature and humidity of an environment around the recording medium.

6. A printing device comprising:

the platen device described in claim 1; and an inkjet printhead.

7. A platen device applying suction to a conveyed recording medium opposite a printhead, comprising:

a platen divided perpendicularly to a conveyance direction of the recording medium into a plurality of suction zones with suction holes in a surface of the platen that contacts the recording medium; and a plurality of shutters respectively opening or closing the suction holes according to a width of the conveyed recording medium, wherein the plural suction zones are divided by a plurality of guide ribs extending in the conveyance direction on the surface of the platen, the suction holes are disposed in a recessed surface of the platen between two adjacent guide ribs, and the shutters are disposed on the recessed surface.

8. The platen device described in claim 7, wherein:

the shutters can move freely forward and back in the conveyance direction between an open position that opens and a closed position that closes the suction holes; and through-holes that communicate with the suction holes in the open position are formed in each shutter.

9. The platen device described in claim 8, wherein:

a protrusion is disposed on a side wall of each of the guide ribs; and two grooves that engage the protrusions in the open position and the closed position are disposed on the shutter.

10. The platen device described in claim 9, further comprising:

a plurality of actuators that respectively open or close the plural shutters; and a control unit that individually controls the plural actuators, the control unit selectively controlling the plural actuators based on an input type of the recording medium.

11. The platen device described in claim 9, further comprising:

a plurality of actuators that respectively open or close the plural shutters; and a control unit that individually controls the plural actuators, the control unit selectively controlling the plural actuators based on an input temperature and humidity of an environment around the recording medium.

* * * * *